US007096902B2

(12) United States Patent
Bott et al.

(10) Patent No.: US 7,096,902 B2
(45) Date of Patent: Aug. 29, 2006

(54) VACUUM CLEANER

(75) Inventors: Erich Bott, Hollstadt (DE); Roland Illig, Heusstreu (DE); Heinrich Komesker, Unkel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/747,707

(22) Filed: Dec. 29, 2003

(65) Prior Publication Data

US 2004/0140708 A1 Jul. 22, 2004

Related U.S. Application Data

(63) Continuation of application No. PCT/EP02/06852, filed on Jun. 20, 2002.

(30) Foreign Application Priority Data

Jun. 29, 2001 (DE) ..... 101 31 696

(51) Int. Cl.
*B60B 9/00* (2006.01)
*B60B 5/02* (2006.01)
*A16C 17/22* (2006.01)

(52) U.S. Cl. ..... 152/5; 301/64.701; 301/5.304

(58) Field of Classification Search ..... 301/5.301, 301/5.304, 5.306–5.309, 64.701, 64.702, 301/64.703, 64.704; 152/1, 5, 17–18, 20, 152/11–12, 69, 74

See application file for complete search history.

(56) References Cited

U.S. PATENT DOCUMENTS 2,878,074 A * 3/1959 Cawl ..... 301/64.707
3,106,409 A * 10/1963 Berlin ..... 280/39
3,604,756 A 9/1971 Gruber
3,870,371 A * 3/1975 Solomon ..... 301/1
3,870,372 A * 3/1975 Knipp ..... 301/64.701
4,170,384 A 10/1979 Rotheiser
4,444,435 A * 4/1984 Honsa ..... 301/64.701
4,530,543 A 7/1985 Keane
4,739,810 A * 4/1988 Markow ..... 152/12
4,896,922 A 1/1990 Güthe
4,934,017 A 6/1990 Kent
5,186,676 A * 2/1993 Morton ..... 446/465
6,279,630 B1 * 8/2001 Herbert IMS ..... 152/84
6,679,560 B1 * 1/2004 van Egeraat ..... 301/5.306

FOREIGN PATENT DOCUMENTS

DE 2 262 437 6/1974
DE 41 05 996 C1 7/1992
DE 199 03 532 C1 4/2000
GB 2 153 757 A 8/1985
GB 2 253 193 A 9/1992

* cited by examiner

*Primary Examiner*—Jason R. Bellinger
(74) *Attorney, Agent, or Firm*—John T. Winburn; Russell W. Wamock; Craig J. Loest

(57) ABSTRACT

A vacuum cleaner includes a housing and at least one running roller operatively connected to the housing. The roller has a hub, a running ring, a wall connecting the running ring and the hub. The wall has two side surfaces and a curved cross-section between the running ring and the hub. The roller has at least one reinforcing rib extending at least from one of the two side surfaces of the wall and being in contact with neither the hub nor the running ring in a non-loaded state of the running roller. The roller forms an elastic caster with a nave and a bearing race. The nave and the bearing race are connected to another by an S or Z-shaped curved wall. Ribs are provided for reinforcing the wall or the nave.

20 Claims, 5 Drawing Sheets

VACUUM CLEANER

CROSS-REFERENCE TO RELATED APPLICATION

This application is a continuation of copending International Application No. PCT/EP02/06852, filed Jun. 20, 2002, which designated the United States and was not published in English.

BACKGROUND OF THE INVENTION

Field of the Invention

The invention relates to a vacuum cleaner equipped with running rollers. U.S. Pat. No. 4,934,017 to Kent discloses a vacuum cleaner that has running rollers. The running rollers have ribs that, extending from a hub of the running wheel, are connected to an outer running surface and provide the running roller with the necessary stability.

SUMMARY OF THE INVENTION

It is accordingly an object of the invention to provide a vacuum cleaner that overcomes the hereinafore-mentioned disadvantages of the heretofore-known devices of this general type and that improves the running properties of the vacuum cleaner.

With the foregoing and other objects in view, there is provided, in accordance with the invention, a vacuum cleaner, includes a housing and at least one running roller operatively connected to the housing and having a hub, a running ring, a wall connecting the running ring and the hub, the wall having two side surfaces and a curved cross-section between the running ring and the hub, and at least one reinforcing rib extending at least from one of the two side surfaces of the wall and being in contact with neither the hub nor the running ring in a non-loaded state of the running roller.

In the case of a vacuum cleaner according to the invention, the running rollers have a wall with a curved cross section between a running ring and a hub. The curved wall between the hub and the running ring provides the running rollers with a high level of elasticity. Even if the running rollers are of a rigid material, the curved shape of the wall is capable of cushioning impact. The running rollers have a straightforward construction and are, thus, cost-effective to produce.

In accordance with another feature of the invention, the at least one running roller is a plurality of running rollers.

In accordance with a further feature of the invention, the reinforcing rib extends from the hub in a direction of the wall and are not in contact with the wall in the non-loaded state of the running roller. In contrast, the reinforcing ribs are in contact with at least one of the hub and the running ring in a loaded state of the running roller.

In accordance with an added feature of the invention, the at least one reinforcing rib is a plurality of reinforcing ribs and the reinforcing ribs extend from the hub in a direction of the wall and are not in contact with the wall in the non-loaded state of the running roller.

In accordance with an additional feature of the invention, there are provided reinforcing ribs disposed on at least one of the two end sides. In such a case, the reinforcing ribs each extend from the wall in the curved region thereof. The reinforcing ribs provide the wall with a higher level of stability.

To not reduce the elasticity, however, the ribs are not connected to the hub or to the running ring.

As an alternative to the ribs being directed inward, from the curved region of the wall, to the hub, they extend, in another embodiment, from the hub and are directed toward the curved region of the wall. It is also the case here that the ribs are not connected to the curved wall, in order not to reduce the elasticity.

In accordance with yet another feature of the invention, the at least one reinforcing rib is a plurality of reinforcing ribs extending at least from one of the two side surfaces of the wall and being in contact with neither the hub nor the running ring in a non-loaded state of the running roller.

In accordance with yet a further feature of the invention, a particularly advantageous embodiment of the vacuum cleaner is one in which the wall has an S-shaped or a Z-shaped structure in cross-section. Such a shape, while using up only a small amount of material, achieves a high level of elasticity.

In accordance with yet an added feature of the invention, the running ring has a convex contour on its running surface. This measure also assists the elasticity of the running rollers.

In the case of the invention, a high level of elasticity is achieved even if use is made of a rigid material. It is, thus, possible for the running roller to be produced, for example, cost-effectively from polypropylene (PP) or one of its copolymers.

In accordance with yet an additional feature of the invention, the running ring of the running roller has a surface made of soft/resilient material. Such a configuration gives rise to additional damping, and it is also possible to achieve improved slipping resistance for the running roller on smooth floors. A running surface made of soft/resilient plastic material is, preferably, integrally molded on the running ring. The running surface may be integrally molded on the running ring in a cost-effective manner by two-component injection molding. Suitable plastic materials that may be used, in particular, are thermoplastic elastomers (TPE) and rubber-based materials.

In accordance with again another feature of the invention, the running ring has a depression and a resilient running surface disposed at the depression.

With the objects of the invention in view, in a vacuum cleaner, there is also provided a roller assembly having at least one running roller having a hub, a running ring, a wall connecting the running ring and the hub, the wall having two side surfaces, and a curved cross-section between the running ring and the hub, and at least one reinforcing rib extending at least from one of the two side surfaces of the wall and being in contact with neither the hub nor the running ring in a non-loaded state of the running roller.

With the objects of the invention in view, there is also provided a roller, including a roller body having a hub, a running ring, a wall connecting the running ring and the hub, the wall having two side surfaces and a curved cross-section between the running ring and the hub, and at least one reinforcing rib extending at least from one of the two side surfaces of the wall and being in contact with neither the hub nor the running ring in a non-loaded state of the running roller.

With the objects of the invention in view, there is also provided a roller including a roller body having a hub, a running ring having a convex running surface, a wall connecting the running ring and the hub, the wall having two side surfaces and a concertina-shaped cross-section between the running ring and the hub, and reinforcing ribs extending at least from one of the two side surfaces of the wall and being in contact with neither the hub nor the running ring in a non-loaded state of the running roller.

Although the invention is illustrated and described herein as embodied in a vacuum cleaner, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
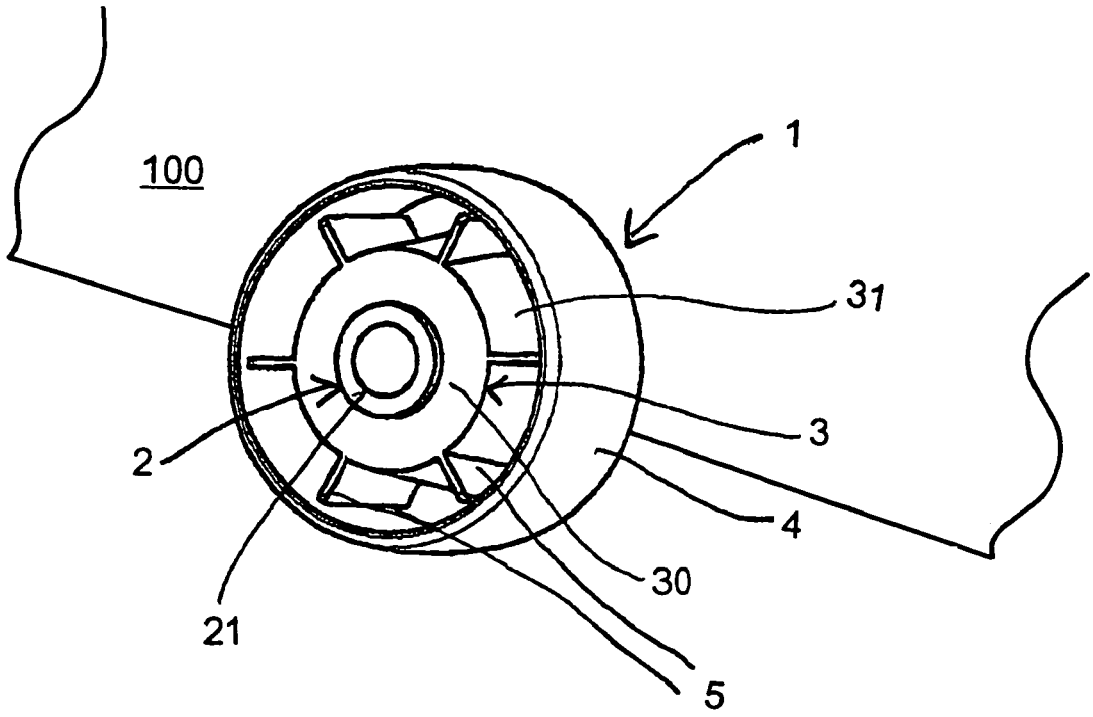
FIG. 1 is a perspective view, from the front side of a running roller for a vacuum cleaner according to the invention.

A vacuum cleaner has running rollers. Referring now to the figures of the drawings in detail and first, particularly to FIG. 1 thereof, there is shown a running roller 1 having a hub 2 through which it is connected with sliding action, or in a state in which it is mounted through ball or rolling-contact bearings, on an axle that is connected to the housing 100 of the vacuum cleaner. The running roller is of a plastic, in particular, a rigid plastic such as polypropylene, but may also be of a plastic with more pronounced elasticity. The hub 2, in the direction of the axle, has a circular protrusion 21 on its front side and a likewise circular protrusion 22 on its rear side.

The hub 2 is adjoined by a wall 3 that connects the hub 2 to a running ring 4. The wall 3 has a first region 30 that extends radially from the hub 2, on the front side, into the vicinity of a center of a radius of the running roller 1. The first region 30 is adjoined by a second region 31, which slopes from the front side to the rear side of the running roller 1. Different slopes may be selected for the first region 31. It is also possible for the second region 31 to run in a coplanar manner in relation to one of the two lateral surfaces of the hub 2 or in a coplanar manner in relation to one of the two lateral surfaces of the running ring 4.

Figure 2:
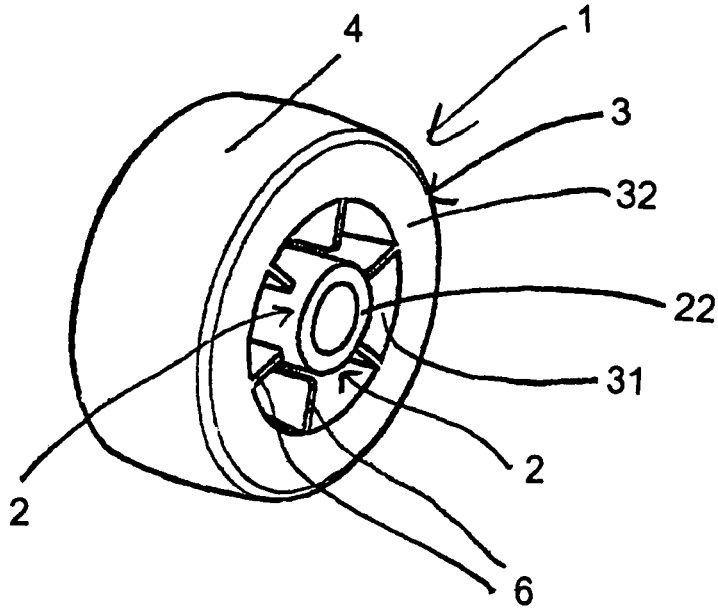
FIG. 2 is a perspective view from the rear side of the running roller of FIG. 1.

The second region 31 is adjoined by a third region 32 (FIG. 2), which extends radially from the second region 31, on the rear side of the running roller 1, as far as the running ring 4. The wall 3, thus, connects the hub to the running ring 4 by way of its three regions 30, 31 and 32.

Ribs 5, 6 are provided to assist the stability of the running roller 1. The ribs 5 extend from the second region 31 of the wall 3 in the direction of the inner lateral surface of the running ring 4, but are not in contact therewith. It is solely in the case of pronounced loading that the ribs 5 can come into contact with the lateral surface.

The ribs 6 extend from the third region 32 of the wall 3 in the direction of the outer lateral surface of the hub 2. It is also the case that the ribs 6 are not in contact with the lateral surface of the hub 2, although they can strike against the hub 2 in the case of pronounced loading.

As an alternative to this configuration of the ribs 6, it is also possible for ribs to be disposed on the outer lateral surface of the hub 2 and to project in the direction of the second region 31 of the wall 3 without being in contact therewith, unless subjected to pronounced loading.

Figure 3:
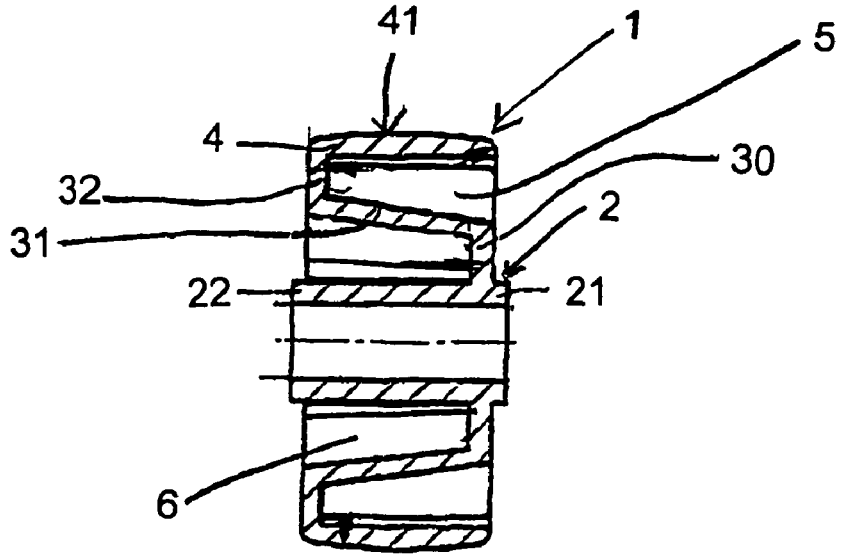
FIG. 3 is a cross-sectional view of the running roller of FIG. 4 along section line A—A.

The running roller, preferably, has a convex running surface 41. See FIG. 3.

Figure 4:
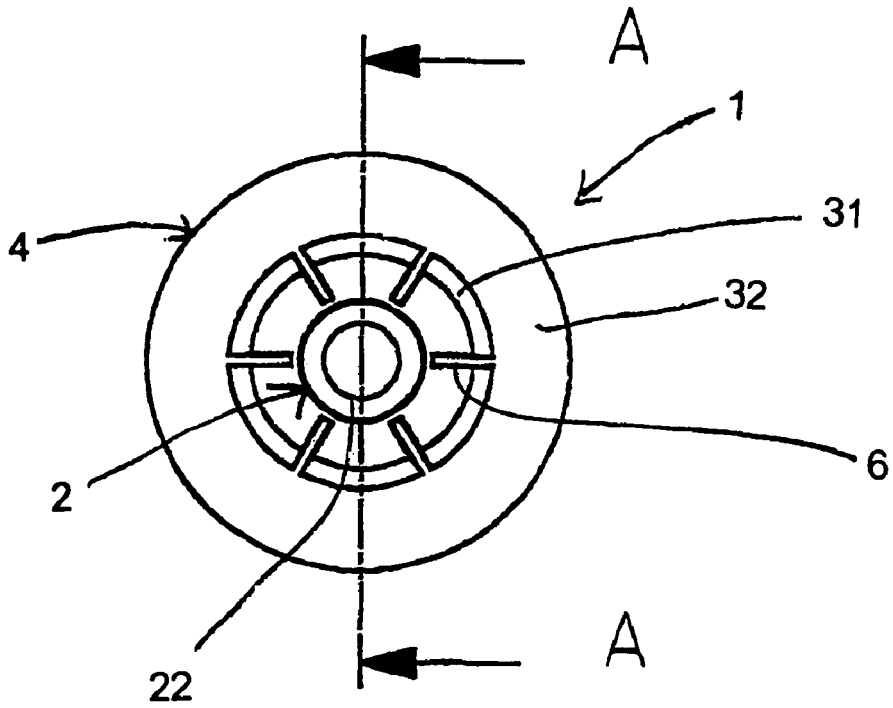
FIG. 4 is a plan view of the rear side of the running roller of FIG. 2.

The curved shape of the wall 3 is either Z-shaped (see FIGS. 3 and 4) or S-shaped. Other curved shapes are also conceivable. In particular, a double-S shape or a double-Z shape is also possible.

An elastic running roller 1 with a hub 2 and a running ring 4 is provided by the present invention. The hub 2 and the running ring 4 are connected to one another by a wall 3 that is curved in an S-shaped or Z-shaped manner. Ribs 5, 6 are provided for reinforcing the wall 3 or the hub 2.

Figure 5:
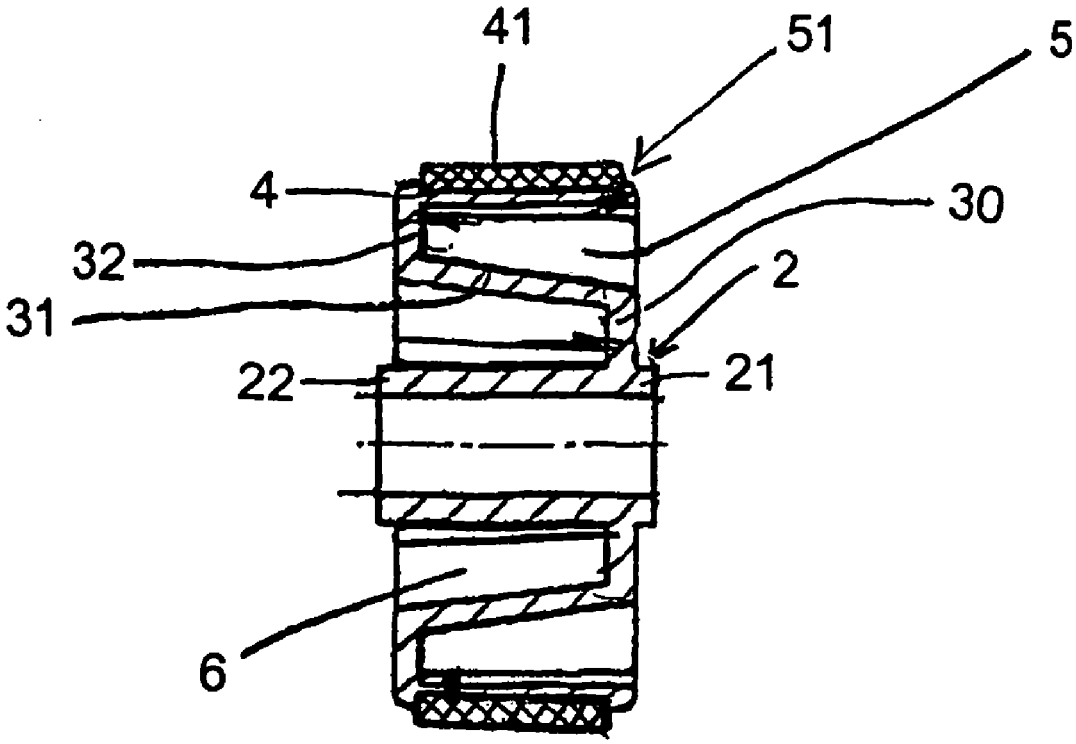
FIG. 5 is a cross-sectional view of the running roller according to the invention with a running surface made of soft/resilient material.

The running ring 4 can have a surface made of soft/resilient material as shown in FIG. 5. A soft/resilient running surface 41 made of a suitable plastic material is integrally formed directly on the running ring 4. It is easily possible for the soft/resilient running surface 41 to be produced together with the running roller 1 by two-component injection molding. The running ring 4 is provided on its surface with a circumferential depression 51, in which the soft/resilient material is integrally formed.

The roller forms an elastic caster with a nave and a bearing race. The nave and the bearing race are connected to another by an S or Z-shaped curved wall. Ribs are provided for reinforcing the wall or the nave.

Figure 6:
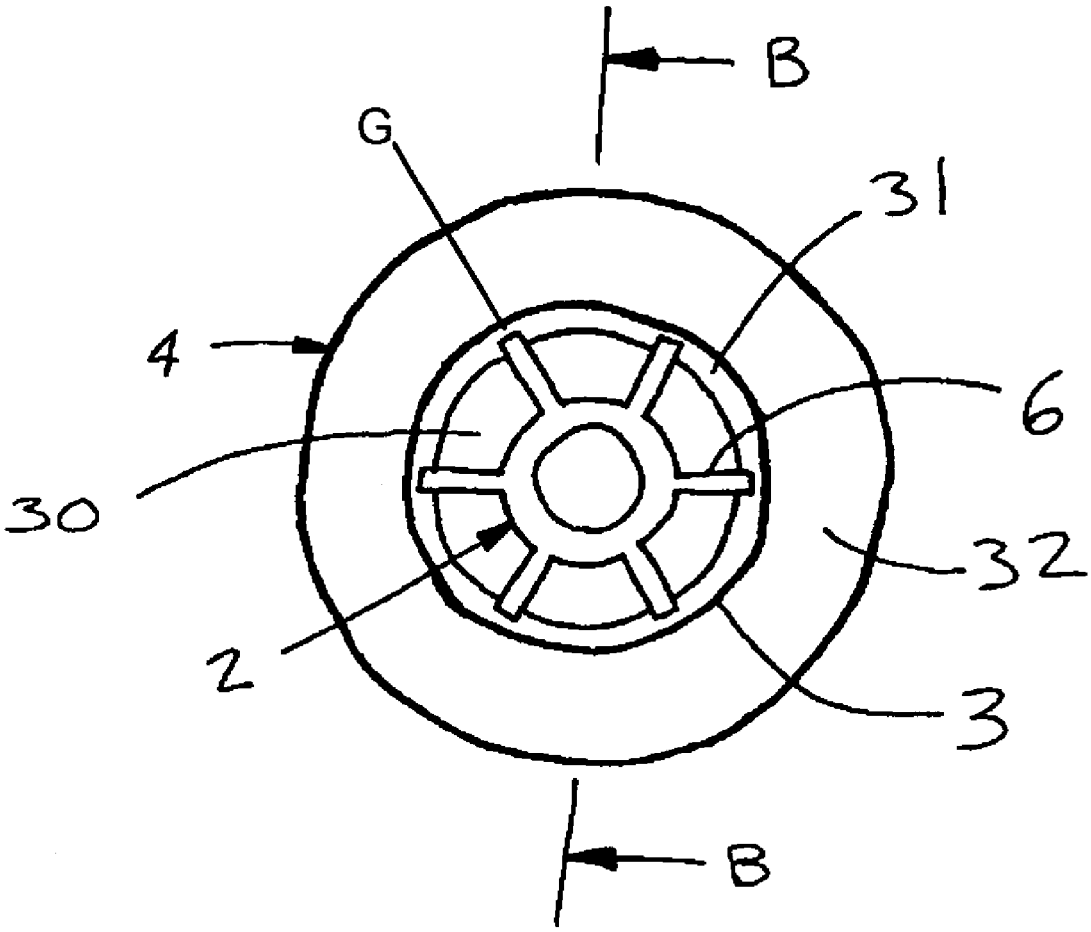
FIG. 6 is a plan view of the rear side of an alternate construction of the running roller.
Figure 7:
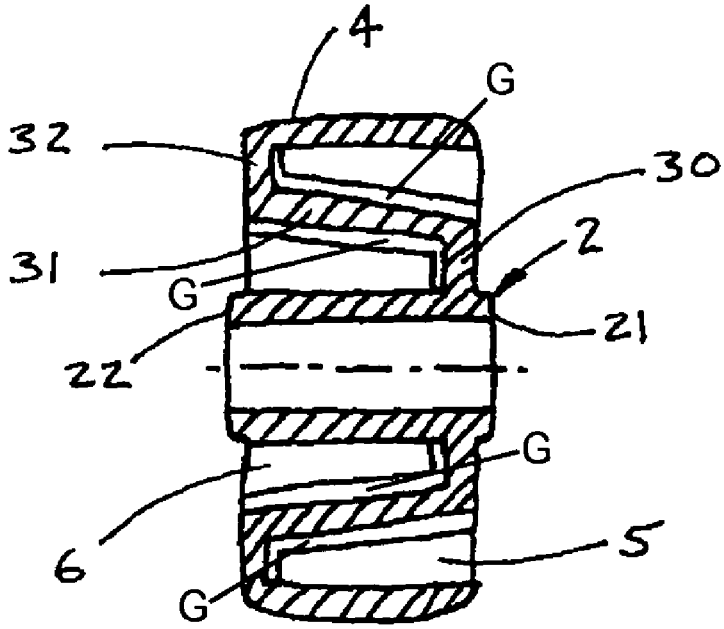
FIG. 7 is a cross-sectional view of the running roller of FIG. 6 alone section line B—B.

FIGS. 6 and 7 illustrate an alternate construction of the roller 1. The rib 5 extends from the running ring 4 toward the second region 31 of the wall 3. The rib 6 extends from the hub 3 toward the second region 31. A gap G is formed between the ribs 5, 6 and the second region 31. The ribs 5, 6 may also be spaced from the first region 30 and the third region 32 with the gap G.

We claim:

1. A vacuum cleaner, comprising:

a housing; and at least one running roller operatively connected to said housing and having:

a hub;

a running ring;

a wall connecting said running ring and said hub, said wall having:

two side surfaces; and a curved cross-section between said running ring and said hub;

at least one reinforcing rib extending from said hub in a direction of said wall and is not in contact with said wall in the non-loaded state of said running roller.

2. The vacuum cleaner according to claim 1, wherein:

said at least one reinforcing rib is a plurality of reinforcing ribs.

3. A vacuum cleaner, comprising:

a housing; and at least one running roller operatively connected to said housing and having:

a hub;

a running ring;

a wall connecting said running ring and said hub, said wall having:

two side surfaces; and a curved cross-section between said running ring and said hub;

at least one reinforcing rib extending from one of said two side surfaces of said wall and being disposed between the wall and at least one of the hub and the running ring, the at least one reinforcing rib having a free end being disposed adjacent and spaced apart from at least one of the hub and the running ring and being in contact with neither said hub nor said running ring in a non-loaded state of said running roller; and wherein said at least one reinforcing rib is a plurality of reinforcing ribs extending at least from one of said two side surfaces of said wall.

4. The vacuum cleaner according to claim 1, wherein said wall has one of the group consisting of an S-shaped cross-section and a Z-shaped cross-section.

5. The vacuum cleaner according to claim 2, wherein said wall has one of the group consisting of an S-shaped cross-section and a Z-shaped cross-section.

6. The vacuum cleaner according to claim 3, wherein said wall has one of the group consisting of an S-shaped cross-section and a Z-shaped cross-section.

7. The vacuum cleaner according to claim 1, wherein said running ring has a convex running surface.

8. The vacuum cleaner according to claim 2, wherein said running ring has a convex running surface.

9. The vacuum cleaner according to claim 3, wherein said running ring has a convex running surface.

10. The vacuum cleaner according to claim 1, wherein said running ring has a depression and a resilient running surface disposed at said depression.

11. The vacuum cleaner according to claim 2, wherein said running ring has a depression and a resilient running surface disposed at said depression.

12. The vacuum cleaner according to claim 3, wherein said running ring has a depression and a resilient running surface disposed at said depression.

13. The vacuum cleaner according to claim 3, wherein said at least one running roller is a plurality of running rollers.

14. The vacuum cleaner according to claim 3, wherein said reinforcing ribs are in contact with at least one of said hub and said running ring in a loaded state of said running roller.

15. A roller, comprising:

a roller body with a front side and a rear side having:

a hub extending between the front side and the rear side;

a running ring extending between the front side and the rear side;

a wall connecting said running ring and said hub, said wall having:

a first region, a second region, and a third region;

the second region extending between the front side and the rear side; and the first region extending between the hub and the second region;

the third region extending between the second region and the running ring;

at least one reinforcing rib extending from the second region of said wall and being disposed between the wall and at least one of the hub and the running ring, the at least one reinforcing rib having a free end being disposed adjacent and spaced apart from at least one of the hub and the running ring and being in contact with neither said hub nor said running ring in a non-loaded state of said running roller.

16. The roller according to claim 15, wherein at least one of the first region and the third region is disposed near the front side and the other of the first region and the third region is disposed near the rear side.

17. The roller according to claim 15, wherein said at least one reinforcing rib includes a plurality of reinforcing ribs extending from the second region.

18. A roller, comprising:

a roller body with a front side and a rear side having:

a hub extending between the front side and the rear side;

a running ring extending between the front side and the rear side;

a wall connecting said running ring and said hub, said wall having:

a first region, a second region, and a third region;

the second region extending between the front side and the rear side; and the first region extending between the hub and the second region;

the third region extending between the second region and the running ring;

at least one reinforcing rib extending from one of the hub and the running ring and being disposed between the wall and at least one of the hub and the running ring, the at least one reinforcing rib having a free end being disposed adjacent and spaced apart from the second region and not being in contact with the second region in a non-loaded state of said roller.

19. The roller according to claim 18, wherein at least one of the first region and the third region is disposed near the front side and the other of the first region and the third region is disposed near the rear side.

20. The roller according to claim 18, wherein said at least one reinforcing rib includes a plurality of reinforcing ribs extending from one of the hub and the running ring.

* * * * *